US010559944B2

(12) United States Patent
Kaji et al.

(10) Patent No.: US 10,559,944 B2
(45) Date of Patent: Feb. 11, 2020

(54) SPARK PLUG FOR INTERNAL COMBUSTION ENGINE

(71) Applicant: DENSO CORPORATION, Kariya, Aichi-pref. (JP)

(72) Inventors: Yuji Kaji, Kariya (JP); Koji Yamanaka, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/088,954

(22) PCT Filed: Mar. 17, 2017

(86) PCT No.: PCT/JP2017/011019

§ 371 (c)(1),
(2) Date: Sep. 27, 2018

(87) PCT Pub. No.: WO2017/169929

PCT Pub. Date: Oct. 5, 2017

(65) Prior Publication Data

US 2019/0214791 A1 Jul. 11, 2019

(30) Foreign Application Priority Data

Mar. 30, 2016 (JP) ..... 2016-069258

(51) Int. Cl.
*H01T 13/20* (2006.01)

(52) U.S. Cl.
CPC ..... *H01T 13/20* (2013.01)

(58) Field of Classification Search
CPC ..... H01T 13/20
See application file for complete search history.

(56) References Cited

U.S. PATENT DOCUMENTS 5,962,957 A 10/1999 Tanaka et al.
6,509,676 B1 * 1/2003 Durling ..... H01T 13/20 123/169 EL (Continued)

FOREIGN PATENT DOCUMENTS

JP 50-125140 10/1975
JP 2-165587 6/1990

(Continued)

OTHER PUBLICATIONS

International Search Report dated Apr. 25, 2017 issued in International application No. PCT/JP2017/011019 (1 pg.).

*Primary Examiner* — Donald L Raleigh
(74) *Attorney, Agent, or Firm* — Nixon & Vanderhye P.C.

(57) ABSTRACT

A spark plug for an internal combustion engine that can improve bonding strength between a center electrode and a conductive glass is provided. The spark plug includes a housing, an insulator, a center electrode, a ground electrode, and a conductive glass. The center electrode has a locking portion that is locked from a base end side to a step portion formed on an inner peripheral surface of the insulator, and an electrode head that is closer to the base end side than the locking portion is. A concave portion is partially formed on the tip end surface of the electrode head. A concave contour, which is an outer peripheral contour of the concave portion when viewed in a plug axial direction, forms a closed curve which is spaced apart from a head contour, which is an outer peripheral contour of the base end surface of the electrode head, and surrounds a center axis (B) of the center electrode. The concave contour has an outward portion protruding toward the head contour and an inward portion protruding toward the center axis (B) of the center electrode.

8 Claims, 13 Drawing Sheets

(56) References Cited

U.S. PATENT DOCUMENTS

| | | | | |
|---|---|---|---|---|
| 2006/0113883 | A1* | 6/2006 | Kanao | H01T 13/20<br>313/141 |
| 2007/0221157 | A1* | 9/2007 | Hagiwara | F02P 9/007<br>123/143 B |
| 2013/0015756 | A1 | 1/2013 | Yamada et al. | |

FOREIGN PATENT DOCUMENTS

| | | |
|---|---|---|
| JP | 5-13147 | 1/1993 |
| JP | 8-315954 | 11/1996 |
| JP | 2010-267425 | 11/2010 |

* cited by examiner

SPARK PLUG FOR INTERNAL COMBUSTION ENGINE

CROSS-REFERENCE TO RELATED APPLICATIONS

This application is the U.S. national phase of International Application No. PCT/JP2017/011019 filed Mar. 17, 2017 which designated the U.S. and claims priority to Japanese Patent Application No. 2016-069258 filed on Mar. 30, 2016, the entire contents of each of which are incorporated herein by reference.

TECHNICAL FIELD

The present disclosure relates to a spark plug for an internal combustion engine used in, for example, an engine of a vehicle.

BACKGROUND ART

In a spark plug for an internal combustion engine, a center electrode is held generally inside a cylindrical insulator. That is, the center electrode is held inside the insulator so that the tip end portion protrudes. Here, the center electrode has a locking portion that is locked from the base end side to a step portion formed on the inner peripheral surface of the insulator, and an electrode head that is formed on the base end side of the locking portion. Electrically conductive glass is filled inside the insulator so as to be located on the base end side of the center electrode. A resistor and a stem are disposed inside the insulator on the base end side of the conductive glass. In this manner, the center electrode is electrically connected to the stem via the conductive glass and the resistor.

Here, the conductive glass is bonded to the electrode head of the center electrode. In order to increase the bonding strength between the electrode head and the conductive glass, PTL 1 proposes a technique to provide a concave portion on the base end surface of the electrode head.

CITATION LIST

Patent Literature

PTL 1: JP H08-315954 A

SUMMARY OF THE INVENTION

Recently, due to reduction in size of a spark plug, there has also been a demand for reducing the diameter of a center electrode. As a result, the contact area between the electrode head and the conductive glass becomes small, and thus the bonding strength therebetween is unlikely to be obtained. That is, in the configuration described in PTL 1, there may be a case where it is difficult to obtain sufficient bonding strength. As a result, for example, when vibration transmitted to the spark plug causes external force in a rotational direction about the center axis to act on the center electrode, in particular, peeling between the center electrode and the conductive glass becomes a problem.

The present disclosure aims to provide a spark plug for an internal combustion engine that can improve bonding strength between a center electrode and a conductive glass.

One aspect of the present disclosure is a spark plug for an internal combustion engine includes a cylindrical housing, a cylindrical insulator held inside the housing, a center electrode held inside the insulator so that a tip end portion protrudes, a ground electrode forming a spark discharge gap between the center electrode and the ground electrode, and a conductive glass filled in the insulator so as to be located at a base end side of the center electrode. The center electrode has a locking portion locked from the base end side to a step portion formed on an inner peripheral surface of the insulator, and an electrode head closer to the base end side than the locking portion is. The electrode head has a base end surface on which a concave portion is partially formed. The concave contour, which is an outer peripheral contour of the concave portion when viewed in a plug axis direction, forms a closed curve which is spaced apart from a head contour, which is an outer peripheral contour of the base end surface of the electrode head, and surrounds the center axis of the center electrode. The concave contour has an outward portion protruding toward the head contour and an inward portion protruding toward the center axis of the center electrode.

In the spark plug, the shape of the concave portion provided in the base end surface of the electrode head of the center electrode is as described above, whereby bonding strength between the center electrode and the conductive glass can be improved.

First, the concave contour forms a closed curve that is spaced apart from the head contour and surrounds the center axis of the center electrode. As a result, strength of the electrode head itself can be secured. As a result, for example, at the time of manufacturing the spark plug, deformation of the electrode head can be prevented, and bonding strength between the center electrode and the conductive glass can be secured.

The concave contour has an outward portion protruding toward the head contour and an inward portion convexly protruding toward the center axis of the center electrode. By adopting such a shape, it is possible not only to improve a contact area between the conductive glass that has entered the concave portion and the electrode head, but also to improve bonding strength between the conductive glass and the center electrode in the rotation direction around the center axis. That is, a portion of the conductive glass that has entered the concave portion, which corresponds to the inside of the outward portion of the concave contour, and a portion of the electrode head, which corresponds to the outside of the inward portion of the concave contour, engage with each other in the rotational direction. Therefore, the bonding strength can be increased between the conductive glass and the center electrode with respect to the force in the rotational direction around the center axis.

As described above, the present disclosure can provide a spark plug for an internal combustion engine that can improve bonding strength between a center electrode and a conductive glass.

BRIEF DESCRIPTION OF DRAWINGS

The above and other objects, features, and advantages of the present disclosure will become clearer from the following detailed description with reference to the accompanying drawings. In the drawings.

DESCRIPTION OF EMBODIMENTS

First Embodiment

An embodiment of a spark plug for an internal combustion engine will be described with reference to FIGS. 1 to 5.

Figure 1:
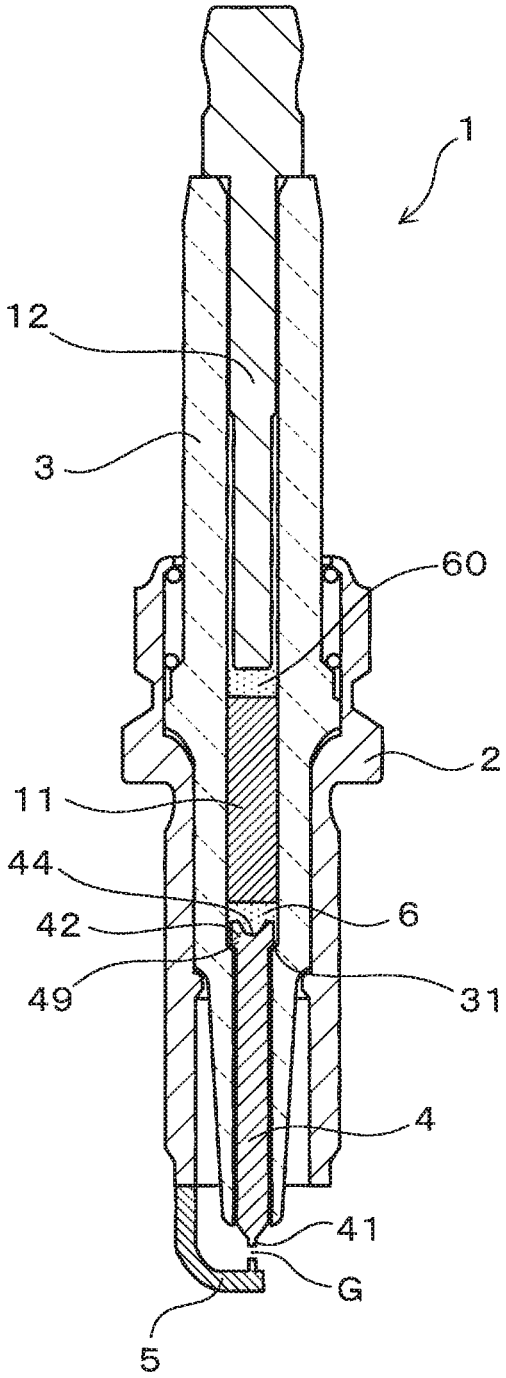
FIG. 1 is a cross-sectional view of a plane including a center axis of a spark plug for an internal combustion engine, according to a first embodiment.

As shown in FIG. 1, the spark plug 1 includes a cylindrical housing 2, a cylindrical insulator 3, a center electrode 4, a ground electrode 5, and a conductive glass 6.

The insulator 3 is held inside the housing 2. The center electrode 4 is held inside the insulator 3 so that the tip end portion 41 protrudes. The ground electrode 5 forms a spark discharge gap G between the center electrode 4 and the ground electrode 5. The conductive glass 6 is filled in the base end side of the center electrode 4 inside the insulator 3.

Herein, the side where the spark plug 1 is inserted into a combustion chamber is referred to as a tip end side, and the opposite side thereof is referred to as a base end side.

Figure 2:
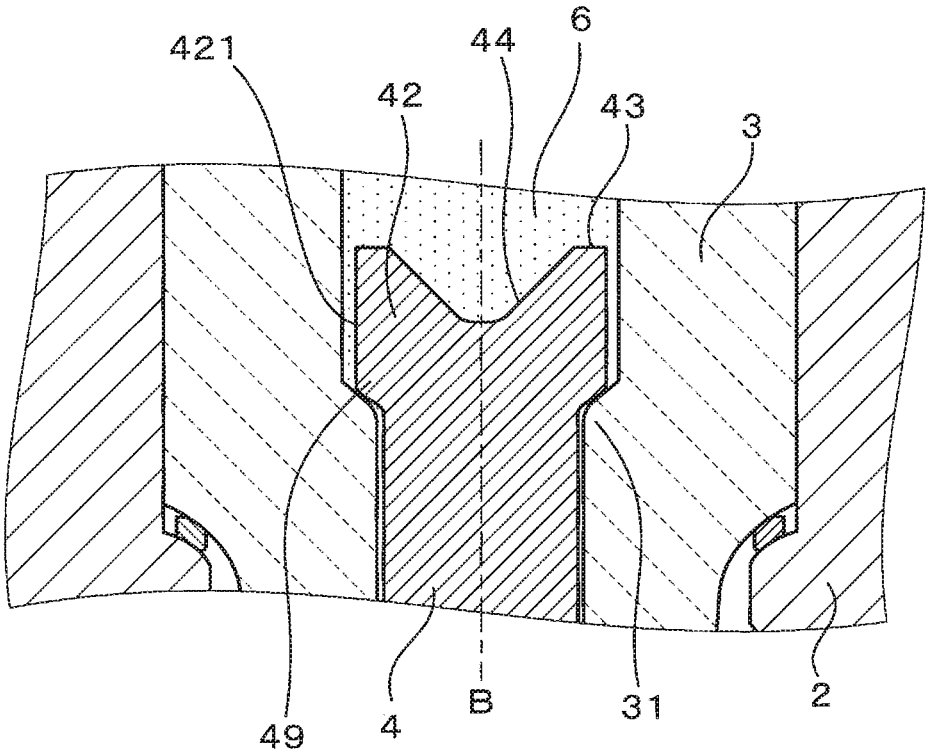
FIG. 2 is an enlarged cross-sectional view of a plane including the center axis of the spark plug in the vicinity of the electrode head, according to the first embodiment.
Figure 3:
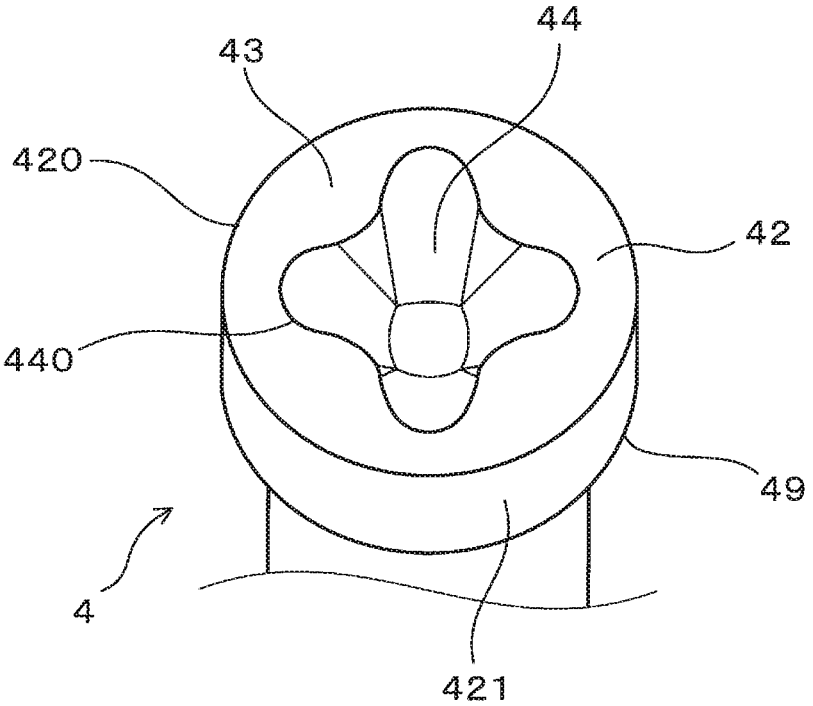
FIG. 3 is a perspective view of the center electrode in the vicinity of the electrode head, according to the first embodiment.

As shown in FIGS. 1, 2, and 3, the center electrode 4 has a locking portion 49 that is locked from the base end side to a step portion 31 formed on the inner peripheral surface of the insulator 3. The center electrode 4 has an electrode head 42 that is closer to the base end side than the locking portion 49 is.

A concave portion 44 is partially formed on the base end surface 43 of the electrode head 42.

Figure 4:
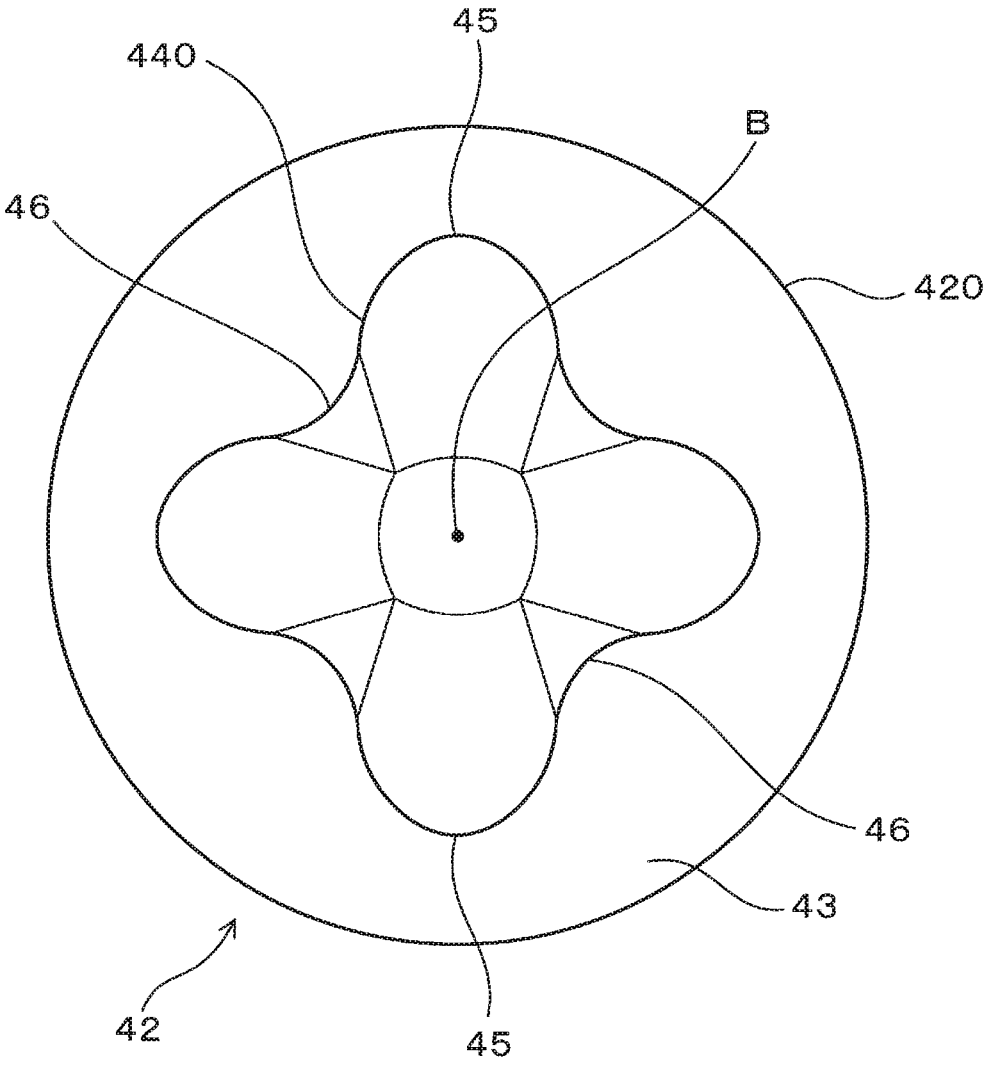
FIG. 4 is a plan view of the electrode head viewed from the base end side, according to the first embodiment.

As shown in FIG. 4, the concave contour 440, which is the outer peripheral contour of the concave portion 44 when viewed in the plug axial direction, forms a closed curve which is spaced apart from the head contour 420, which is the outer peripheral contour of the base end surface 43 of the electrode head 42, and surrounds the center axis B of the center electrode 4. Here, although the plug axial direction is the axial direction of the spark plug 1, the plug axial direction agrees with the axial direction of the center electrode 4.

In addition, the concave contour 440 has an outward portion 45 and an inward portion 46. The outward portion 45 is a portion of the concave contour 440 that is protruding toward the head contour 420. The inward portion 46 is a portion of the concave contour 440 that protrudes convexly toward the center axis B of the center electrode 4.

In the present embodiment, the concave contour 440 has four outward portions 45 and four inward portions 46. The concave contour 440 has a substantially rotationally symmetrical shape about the center axis B. Specifically, the concave contour 440 has a four-fold rotationally symmetrical shape.

The head contour 420 has a circular shape with the center axis B as the center. Here, the head contour 420 is an outer peripheral contour of the base end surface 43. However, when a tapered surface or a curved surface is formed at a corner portion between the outer peripheral side surface 421 and the base end surface 43 of the electrode head portion 420 in an axial range smaller than the depth of the concave portion 44, a boundary line between the tapered surface or the curved surface and the outer peripheral side surface 421 becomes the head contour 420.

As described above, the concave contour 440 is spaced apart from the head contour 420. That is, the concave contour 440 is formed inside the head contour 420, and is formed so as not to overlap with the head contour 420 over the entire circumference. As a result, the material of the electrode head 42 is present over the entire circumference of the outer periphery of the concave portion 44.

Figure 5:
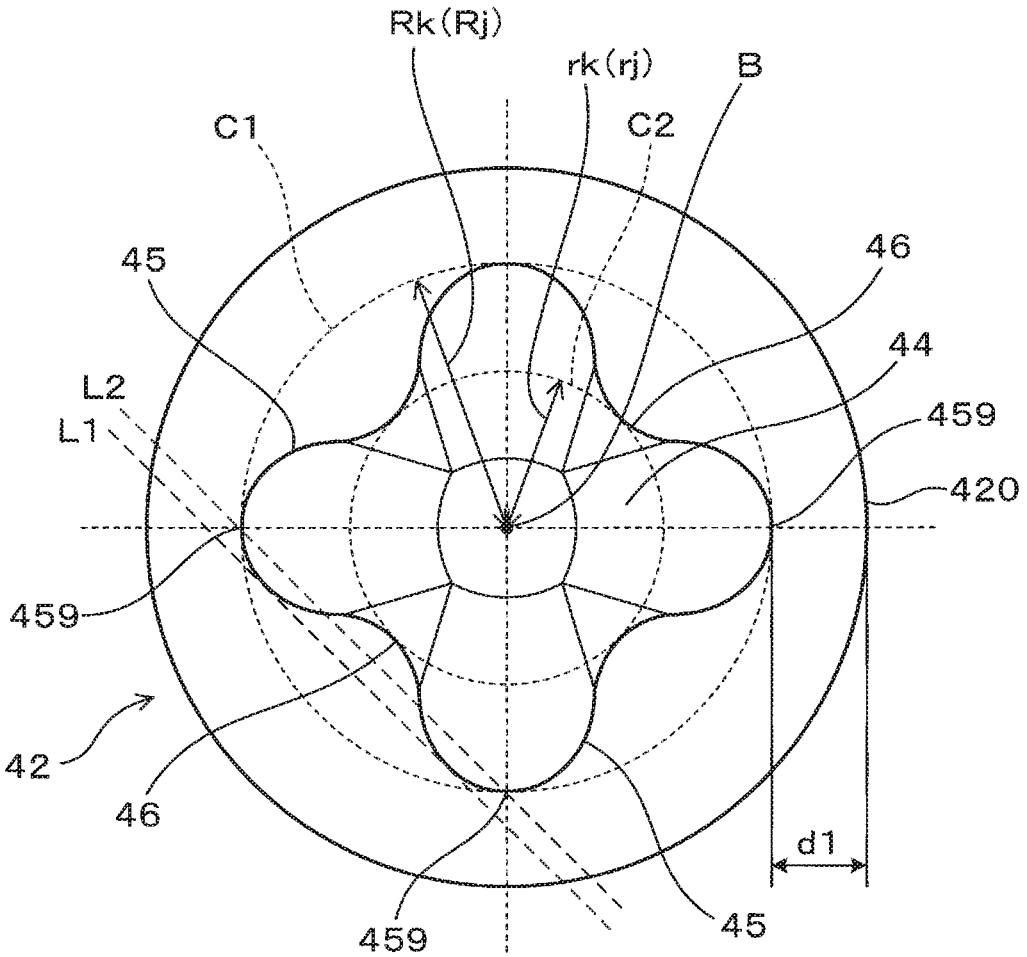
FIG. 5 is a plan view illustrating the electrode head with various auxiliary lines added to FIG. 4.

The distance between the concave contour 440 and the head contour 420 is 0.1 mm or more. That is, as shown in FIG. 5, the distance d1 is 0.1 mm or more in the portion of the concave contour 440 which has the shortest distance from the head contour 420. That is, a metallic material having a wall thickness of 0.1 mm or more is present over the entire circumference of the concave portion 44. Specifically, the distance d1 between the apex portion 459 of the outward portion 45 and the head contour 420 of the concave contour 440 is 0.1 mm or more.

The outward portion 45 is formed in a curved shape. The curved line of the outward portion 45 is composed of a combination of curves having a radius of curvature of 0.1 mm or more. That is, the apex portion 459 of the outward portion 45 is also curved, and the radius of curvature thereof is 0.1 mm or more.

The inward portion 46 is also formed in a curved shape. The outward portion 45 and the inward portion 46 are smoothly connected to each other.

The inward portion 46 protrudes further toward the center axis B side beyond the straight line L1 contacting both of the pair of adjacent outward portions 45. Further, in the present embodiment, the inward portion 46 protrudes further toward the center axis B side beyond the straight line L2 connecting apex portions 459 of the pair of adjacent outward portions 45.

As shown in FIG. 2, the concave portion 44 is formed so that the vicinity of the center axis B becomes the deepest. The bottom portion of the concave portion 44 is formed in a curved surface shape. The maximum depth of the concave portion 44 may be, for example, 0.5 to 1.5 mm.

As shown in FIGS. 1 to 3, the center electrode 4 has a substantially cylindrical shape, and the tip end portion 41 thereof has a small diameter. The tip end portion 41 may be formed of a noble metal tip made of an iridium alloy or the like. A large-diameter locking portion 49 is formed in the vicinity of the base end portion of the center electrode 4. In the present embodiment, the entire portion of the locking portion 49 on the base end side is the electrode head 42. The electrode head 42 also has a substantially cylindrical shape.

The center electrode 4 has a core material made of copper or the like, and a coating material covering the tip end side and the outer peripheral side thereof. The coating material is made of, for example, a nickel base alloy. Although not shown, the core material is exposed to a part of the base end surface 43. A concave portion 44 is formed in the exposed portion of the core material. That is, in the present embodiment, the concave portion 44 is formed on the inner side of the portion of the coating material of the base end surface 43.

As shown in FIG. 1, a conductive glass 6 is filled inside the insulator 3, which has a substantially cylindrical shape, on the base end side of the center electrode 4. Inside the insulator 3, a resistor 11 and a stem 12 are disposed on the base end side of the conductive glass 6. A conductive glass 60 is also disposed between the resistor 11 and the stem 12. The center electrode 4 is electrically connected to the stem 12 via the conductive glasses 6 and 60, and the resistor 11.

The conductive glass 6 is bonded to the electrode head 42 of the center electrode 4. That is, the conductive glass 6 closely contacting the outer peripheral side surface 421 of the electrode head 42, the base end surface 43, and the inner surface of the concave portion 44. The conductive glass 6 is made of, for example, glass containing a conductor such as copper.

When assembling the spark plug 1, the center electrode 4 is first inserted into the insulator 3. That is, the center electrode 4 is inserted from the base end of the insulator 3 to the inside of the insulator 3. Then, the locking portion 49 of the center electrode 4 is locked to the step portion 31 of the insulator 3. Thereby, the center electrode 4 is disposed at a predetermined position of the tip end portion of the insulator 3.

Next, a powder material which becomes the conductive glass 6 is filled inside the insulator 3 and is disposed on the base end side of the center electrode 4. Further, the powder material of the resistor 11, the powder material of the conductive glass 60, and the stem 12 are sequentially disposed inside the insulator 3. Then, the powder material filled inside the insulator 3 is heated and melted while pressing the stem 12 toward the tip end side with respect to the insulator 3. Thereafter, by cooling, the respective powder materials become the conductive glasses 6 and 60, and the resistor 11, and are fixed inside the insulator 3. The conductive glass 6 is fixed to the electrode head 42 of the center electrode 4 and to the inner walls of the resistor 11 and the insulator 3. The conductive glass 60 disposed on the base end side of the resistor 11 is bonded to the inner walls of the resistor 11, the stem 12, and the insulator 3.

In the manufacturing process described above, the conductive glass 6 enters between the outer peripheral side surface 421 of the electrode head 42 of the center electrode 4 and the inner wall of the insulator 3, and also enters the concave portion 44. As a result, the conductive glass 6 bonds the electrode head 42 from the inner surface of the concave portion 44 as well as the outer peripheral side surface 421 and the base end surface 43 of the electrode head 42.

Next, effects of the present embodiment will be described.

In the spark plug 1, by forming the concave contour 440 into a shape as shown in FIGS. 4 and 5, the bonding strength between the center electrode 4 and the conductive glass 6 can be improved.

First, the concave contour 440 forms a closed curve that is spaced apart from the head contour 420 and surrounds the center axis B. Consequently, the strength of the electrode head 42 can be secured. That is, the strength of the electrode head 42 can be effectively secured by the material of the electrode head 42 being present over the entire circumference of the outer periphery of the concave portion 44. Consequently, at the time of manufacturing the spark plug 1 or the like, the deformation of the electrode head 42 can be prevented, and the bonding strength with respect to the conductive glass 6 can be secured.

In addition, by setting the distance d1 between the concave contour 440 and the head contour 420 to 0.1 mm or more, the strength of the electrode head 42 can be increased.

The concave contour 440 has the outward portion 45 and the inward portion 46. By adopting such a shape, it is possible not only to improve the contact area with the conductive glass 6 that has entered the concave portion 44, but also to improve the bonding strength between the conductive glass 6 and the center electrode 4 in the rotation direction around the center axis B. That is, a portion of the conductive glass 6 that has entered the concave portion 44 that corresponds to the inner side of the outward portion 45 of the concave contour 440 and a portion of the electrode head 42 that corresponds to the outer side of the inward portion 46 engage with each other in the rotational direction. Therefore, the bonding strength can be increased between the conductive glass 6 and the center electrode 4 with respect to the force in the rotational direction around the center axis B. In particular, a portion on the outer side of the inward portion 46 and on the center axis B side with reference to the straight line L1 shown in FIG. 5 receives force in the rotational direction sufficiently.

The outward portion 45 is formed in a curved shape. Accordingly, the strength of the conductive glass 6 provided inside the outward portion 45 can be easily secured. In particular, the curved line of the outward portion 45 is configured by a combination of curves having a radius of curvature of 0.1 mm or more. As a result, the strength of the conductive glass 6 inside the outward portion 45 can be secured.

As described above, according to the above aspect, a spark plug for an internal combustion engine which can improve the bonding strength between the center electrode and the conductive glass can be provided.

Second Embodiment

Figure 6:
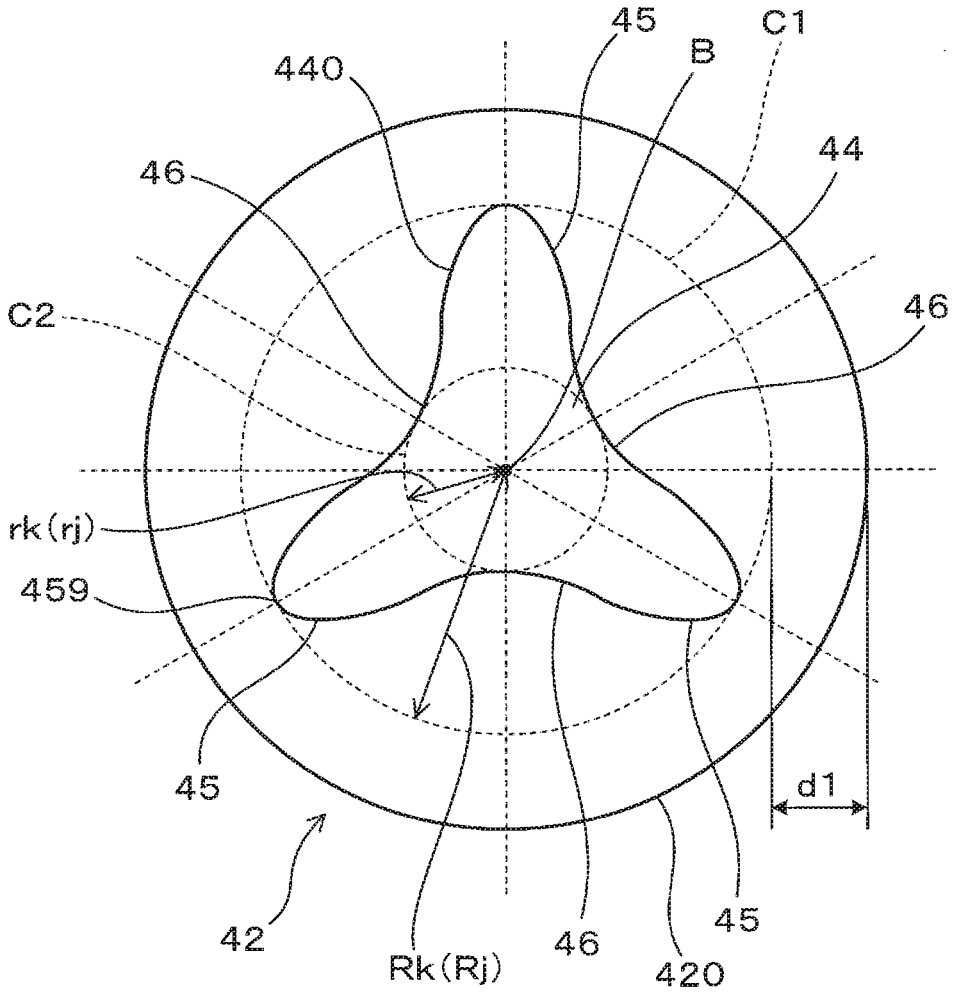
FIG. 6 is a plan view of the electrode head viewed from the base end side, according to a second embodiment.

In present embodiment, as shown in FIG. 6, the shape of the concave contour 440 is varied from that of the first embodiment.

The concave contour 440 shown in FIG. 6 has three outward portions 45 and three inward portions 46. The concave contour 440 has a three-fold rotationally symmetrical shape.

Other configurations are the same as those of the first embodiment, and the same effects are obtained. Note that, among the reference signs used in the second embodiment and the subsequent embodiments, the same reference signs as those used in the embodiments described indicate the same components and the like as those in the embodiments, unless otherwise indicated.

Third Embodiment

Figure 7:
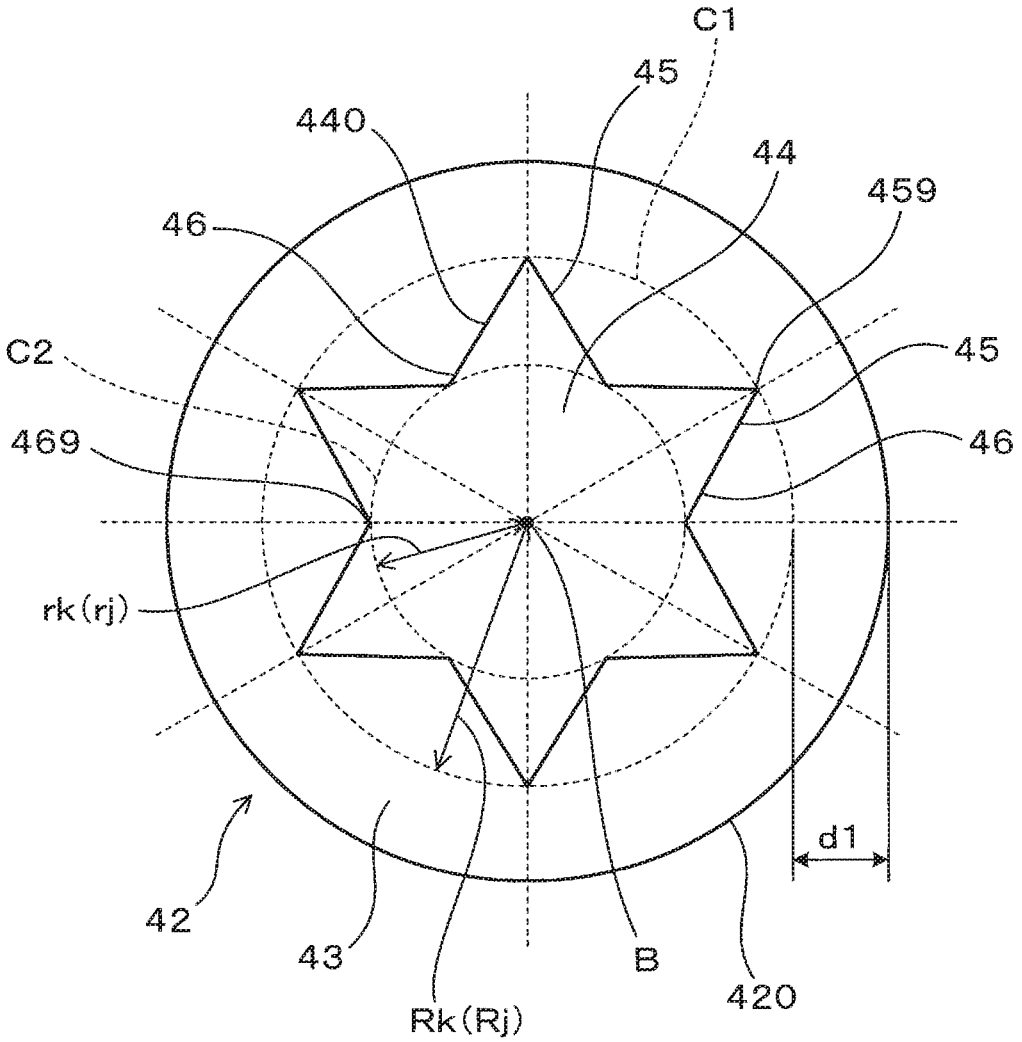
FIG. 7 is a plan view of the electrode head viewed from the base end side, according to a third embodiment.

As shown in FIG. 7, the present embodiment is also different from the first embodiment in the shape of the concave contour 440.

The concave contour 440 shown in FIG. 7 has six outward portions 45 and six inward portions 46. The concave contour 440 has a six-fold rotationally symmetrical shape. In the concave contour 440, the apex portion 459 of the outward portion 45 and the apex portion 469 of the inward portion 46 are not curved. However, these apex portions 459 and 469 may be curved.

Other configurations are the same as those of the first embodiment, and the same effects are obtained.

Fourth Embodiment

Figure 8:
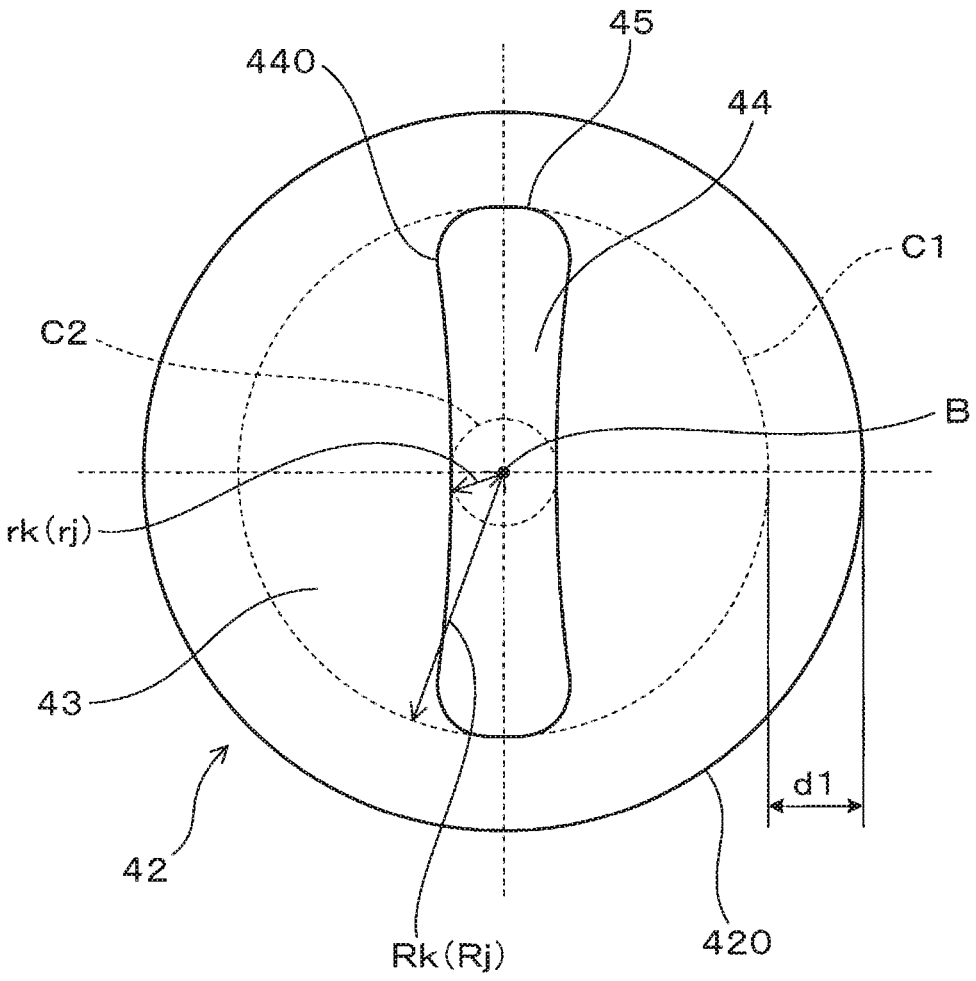
FIG. 8 is a plan view of the electrode head viewed from the base end side, according to a fourth embodiment.

As shown in FIG. 8, in the present embodiment, two outward portions 45 and two inward portions 46 are provided in the concave contour 440. The concave contour 440 has a two-fold rotationally symmetrical shape.

The other configurations are the same as those of the first embodiment. The present embodiment also has the same effect as those of the first embodiment.

First Experimental Example

In the present example, the bonding strength between the electrode head 42 and the conductive glass 6 was evaluated for the spark plugs described in the above-mentioned first embodiment to fourth embodiment.

First, samples of various spark plugs were produced by varying the dimensional relationships and the like of the concave contours 440 shown in the first to fourth embodiments based on the respective shapes thereof. That is, the basic shapes of the concave contour 440 include a shape having two outward portions 45 and two inward portions 46 (see FIG. 8), a shape having three outward portions 45 and three inward portions 46 (see FIG. 6), a shape having four outward portions 45 and four inward portions 46 (see FIG. 5), and a shape having six outward portions 45 and six inward portions 46 (see FIG. 7). These shapes are generalized and defined as the concave contour in which each of the number of the outward portions 45 and the number of the inward portions 46 is N, as below.

That is, the concave contour 440 includes N outward portions 45 and N inward portions 46 alternately arranged in the circumferential direction. The 1st outward portion 45 to the Nth outward portion 45 are sequentially arranged in the circumferential direction, and the 1st inward portion 46 to the Nth inward portion 46 are sequentially arranged in the circumferential direction. The kth outward portion 45 and the kth inward portion 46 are adjacent to each other. Let us assume that Rk is the radius of the circumscribed circle C1 of the kth outward portion 45 centering on the central axis B. Let us assume that rk is the radius of the inscribed circle C2 of the kth inward portion 46 centering on the central axis B. Here, N is a natural number of 2 or more, and k is a natural number of 1 to N.

In FIGS. 5 to 8, a circumscribed circle C1 and an inscribed circle C2 are drawn by dash lines, and radii Rk and rk are written. Since the concave contours 440 shown in FIGS. 5 to 8 have a rotationally symmetrical shape, Rk and rk are constant regardless of k. Therefore, the circumscribed circles C1 and the inscribed circles C2 respectively overlap one another. However, since the actual sample does not have a perfectly rotationally symmetric shape, each of Rk and rk is slightly changed depending on k.

In each of the basic shapes described above, a sample having the concave contour 440 in which Rk and rk are variously changed was produced. The samples were tested for impact resistance as specified in the JIS B 8031. In the evaluation, the rate of change of the resistance before and after the impact resistance test was examined. The rate of change of the resistance is the rate of change of the resistance between the center electrode 4 and the stem 12. If the rate of change of the resistance is 10% or less, the bonding strength between the electrode head 42 and the conductive glass 6 is evaluated as being sufficient.

Figure 9:
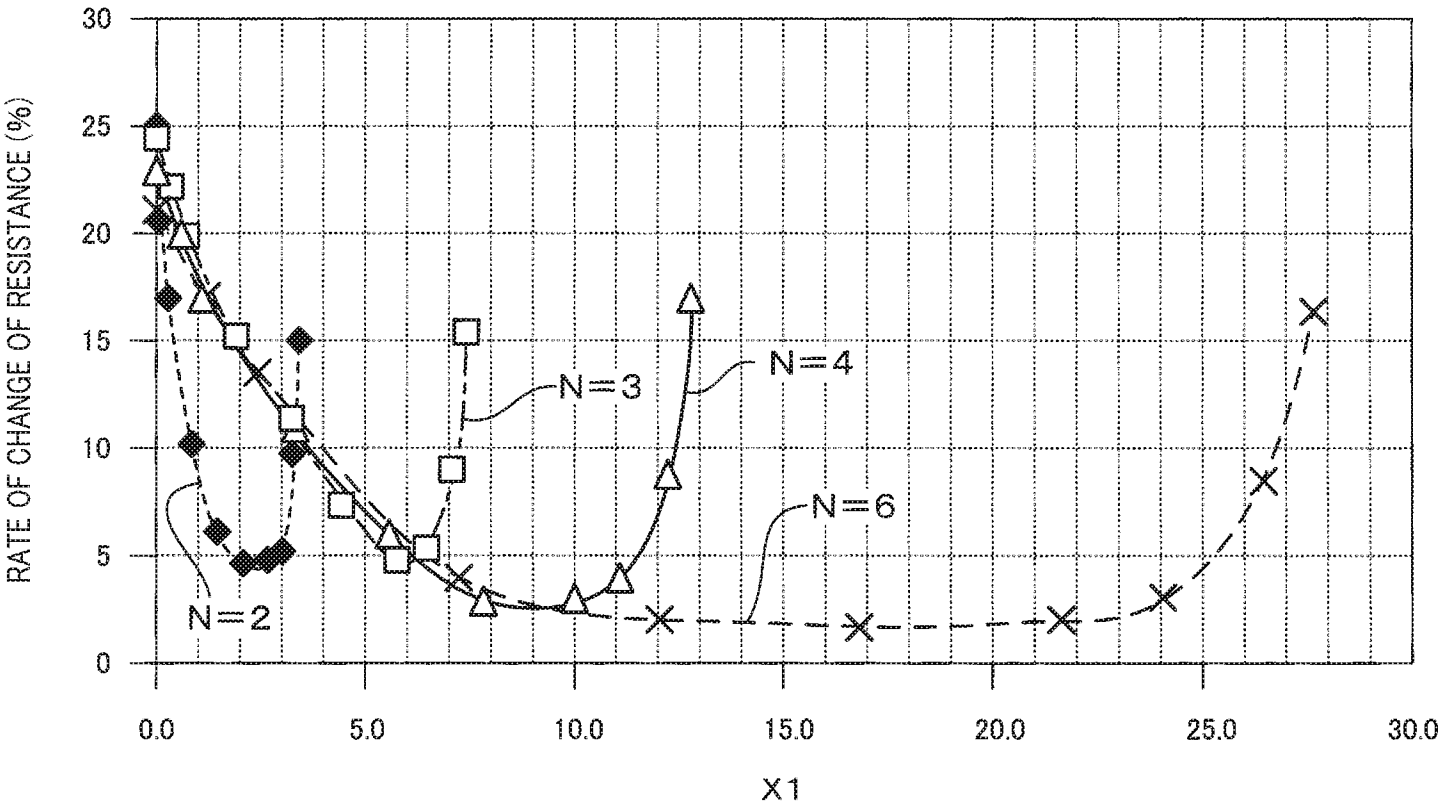
FIG. 9 is a diagram showing a relationship between a parameter X1 and a rate of change of resistance, according to a first experimental example.

After analyzing the results of the measurement, the rate of change of resistance is plotted on the vertical axis and the parameter X1 is plotted on the horizontal axis, and the measurement data is plotted in FIG. 9. The parameter X1 is expressed by the following expression (3), and is a parameter corresponding to the left side of the expression (1) described later.

[Expression 1]

$$X1 = \sum_{k=1}^{N} \frac{Rk - rk}{Rk} \times N^{0.9} \qquad \text{(expression 3)}$$

In FIG. 9, data of the samples having the same N are connected by various curved lines. As can be seen from the figure, the rate of change of the resistance increases when X1=0 is almost satisfied for any curved line. This indicates that if the undulation of the concave contour 440 is too gentle, the bonding strength between the electrode head 42 and the conductive glass 6 decreases.

For the data of N=3, N=4, and N=6, by setting the parameter X1 to 4.1 or more, the rate of change of the resistance becomes 10% or less. On the other hand, for the data of N=2, by setting the parameter X1 to 1.0 or more, the rate of change of the resistance becomes 10% or less. From these results, it can be said that the parameter X1 can be used as an appropriate index for indicating a degree to which the undulation of the concave contour 440 is not too gentle.

It can be said that the shape of the concave contour 440 is preferably such that the inequality of the following expression (1) is satisfied. Where A=1.0 when N=2, and A=4.1 when N≥3, then:

[Expression 2]

$$\sum_{k=1}^{N} \frac{Rk - rk}{Rk} \times N^{0.9} \geq A \qquad \text{(Expression 1)}$$

Figure 10:
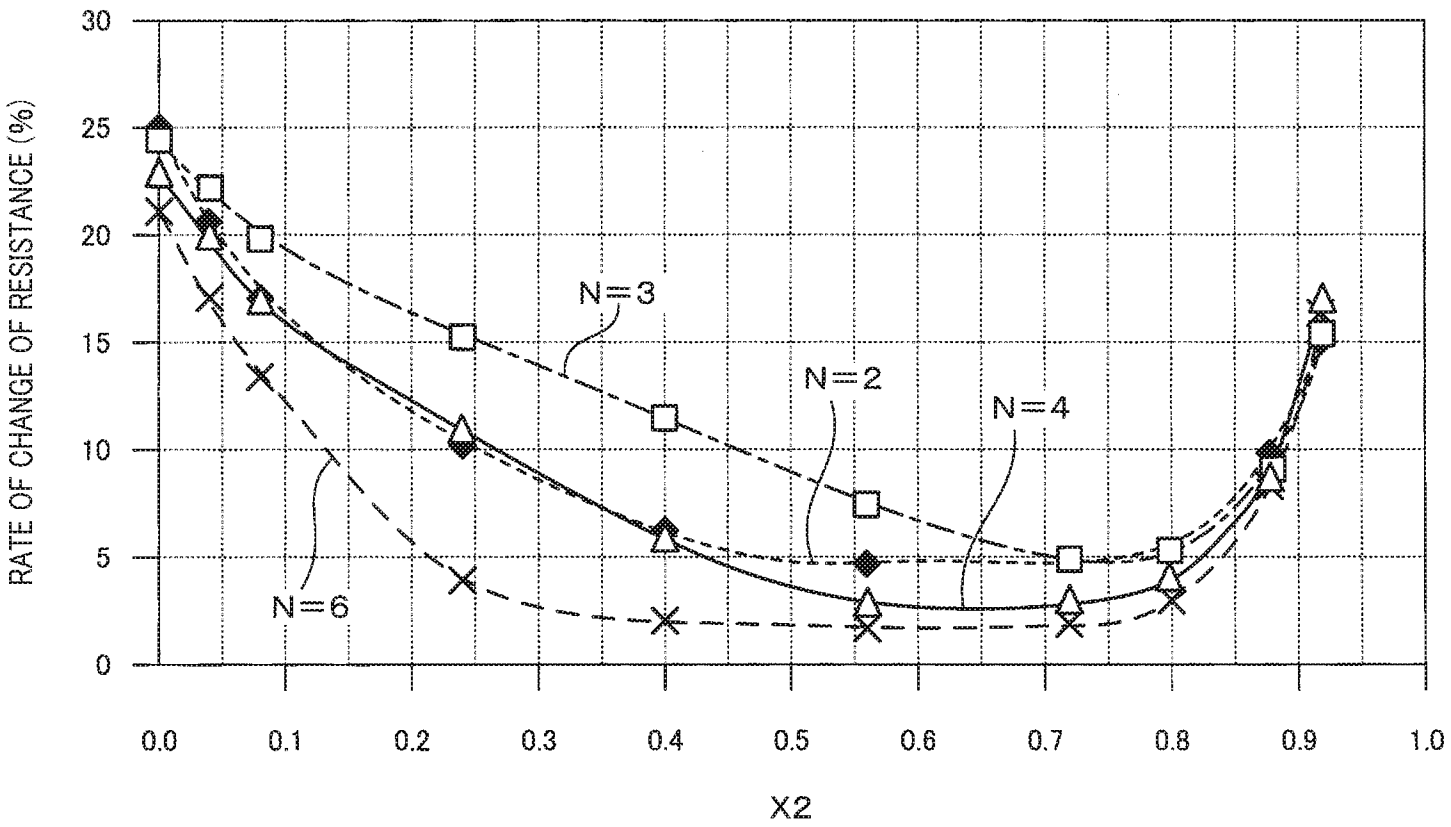
FIG. 10 is a diagram showing a relationship between a parameter X2 and a rate of change of resistance, according to the first experimental example.

Further, after the result of the rate of change of the resistance in the above impact resistance test being analyzed, the measured data is plotted as shown in FIG. 10, where the vertical axis shows the rate of change of the resistance and the horizontal axis shows the parameter X2. The parameter X2 is expressed by the following expression (4), and is a parameter corresponding to the left side of the expression (2) described later.

$$X2=(Rj-rj)/Rj \qquad \text{Expression (4)}$$

Here, in at least one pair of the outward portion 45 and the inward portion 46 adjacent to each other, the radius of the circumscribed circle C1 of the outward portion 45 is Rj, and the radius of the inscribed circle C2 of the inward portion 46 is rj. However, in the data plotted in the graph of FIG. 10, a combination of the outward portion 45 and the inward portion 46 adjacent to each other is selected such that X2 becomes the smallest is selected, and values of X2 when radii thereof are Rj and rj are adopted.

Also in FIG. 10, data of the samples having the same N are connected by various curved lines. As can be seen from the figure, for any curved line, if the parameter X2 becomes too large, the rate of change of the resistance becomes large. It is considered that this is because, if the undulation of the concave contour 440 becomes too significant over the entire circumference, the conductive glass 6 cannot sufficiently enter inside the concave portion 44.

Then, regardless of the value of N, by setting the parameter X2 to 0.87 or less, the rate of change of the resistance can be suppressed to 10% or less. From this result, it can be said that the parameter X2 can be used as an appropriate index as a degree to which the undulation of the concave contour 440 is not too significant.

It is further preferable that at least one pair of the outward portion 45 and the inward portion 46 adjacent to each other satisfies the following expression (2) as the concave contour 440. However, the radius of the circumscribed circle C1 of the outward portion 45 is defined as Rj, and the radius of the inscribed circle C2 of the inward portion 46 is defined as rj.

$$(Rj-rj)/Rj \leq 0.87 \qquad \text{Expression (2)}$$

Second Experimental Example

Figure 11:
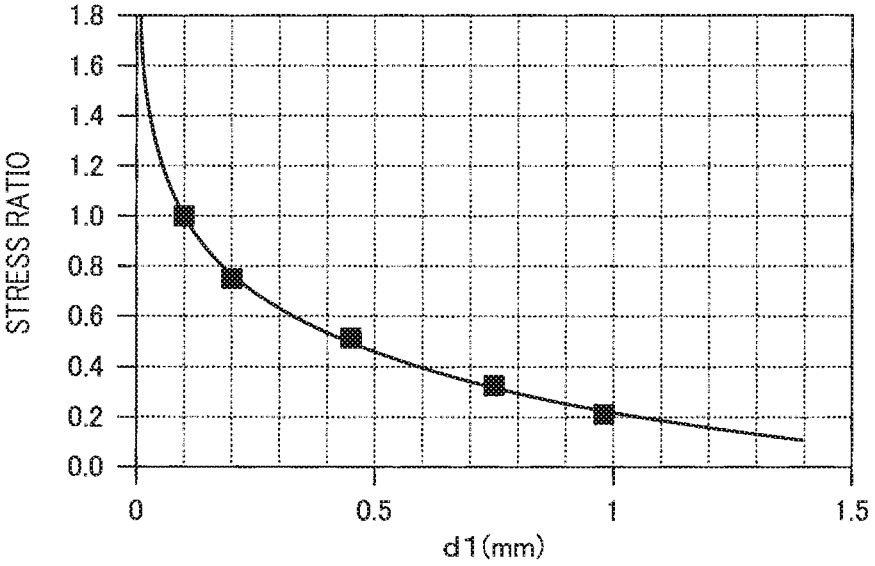
FIG. 11 is a diagram showing a relationship between a distance d1 and a stress ratio, according to a second experimental example.

In this example, as shown in FIG. 11, the relationship between the distance d1 between the concave contour 440 and the head contour 420, and the strength of the electrode head 42 was examined.

That is, the FEM analysis was performed on the assumption of the pressurizing force applied to the electrode head 42 of the center electrode 4 when the spark plug 1 was actually manufactured. Here, FEM is an abbreviation for finite element method, and FEM means the finite element method. As a sample, a plurality of samples were prepared in which the concave contour 440 in the electrode head 42 shown in the first embodiment was changed little by little while the concave contour 440 was set as a basic shape. The concave contours 440 of the samples change the distance d1 from each other.

For each of the samples, FEM analysis was performed on the assumption described above. For each of the samples, the most stressed portion of the electrode head 42 was a portion between the apex portion 459 of the outward portion 45 and the head contour 420. A value expressed by the ratio of stress at the stress concentration portion to the material strength was calculated as a stress ratio. The stress ratio of each of the samples is plotted in FIG. 11. In the figure, the vertical axis represents the stress ratio, and the horizontal axis represents the distance d1. The material of the stress concentration portion of the electrode head 42 is a Ni-based alloy.

As can be seen from the figure, by setting d1≥0.1 mm, the stress ratio can be set to 1.0 or less. That is, by setting d1≥0.1 mm, the stress acting on the electrode head 42 at the time of manufacturing the spark plug 1 can be prevented from exceeding the material strength. That is, by securing d1≥0.1 mm, the deformation of the electrode head 42 can be prevented at the time of manufacturing the spark plug 1.

Figure 12:
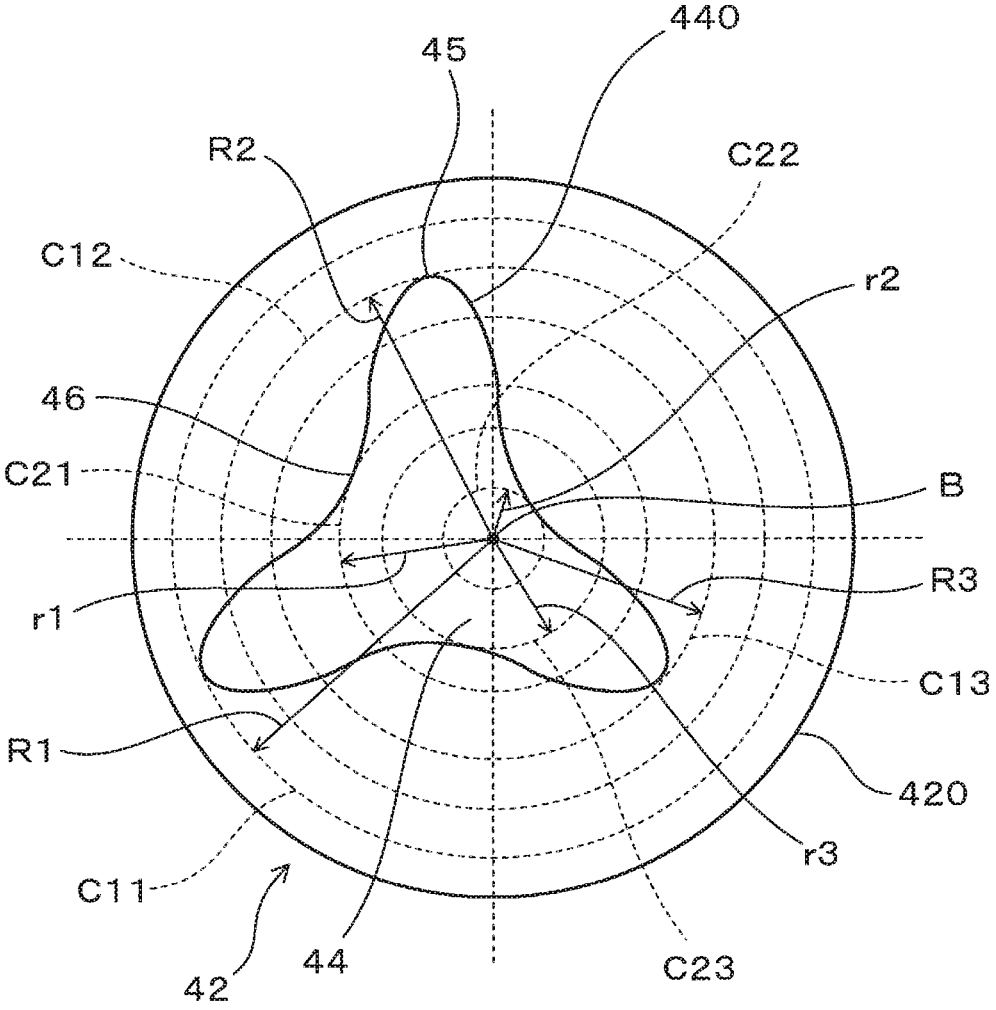
FIG. 12 is a plan view of an example of an electrode head in which a concave contour has a non-rotationally symmetrical shape.
Figure 13:
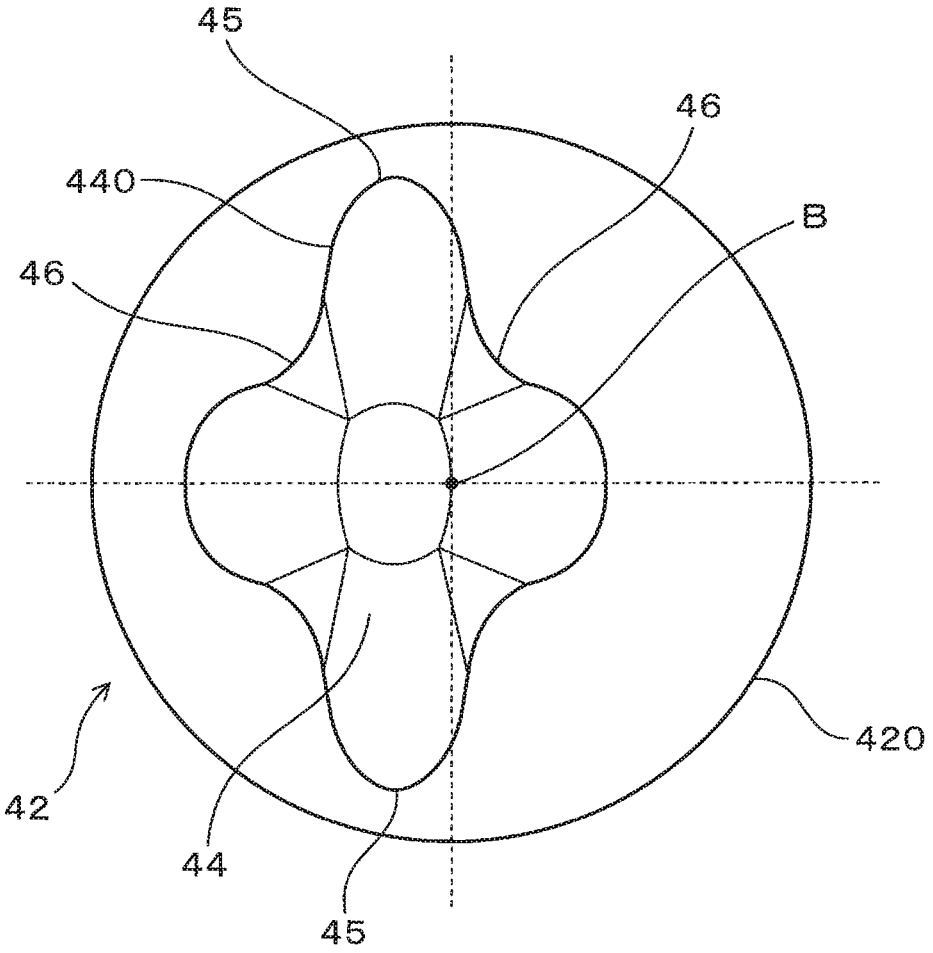
FIG. 13 is a plan view of another example of the electrode head in which the concave contour has a non-rotationally symmetrical shape.
Figure 14:
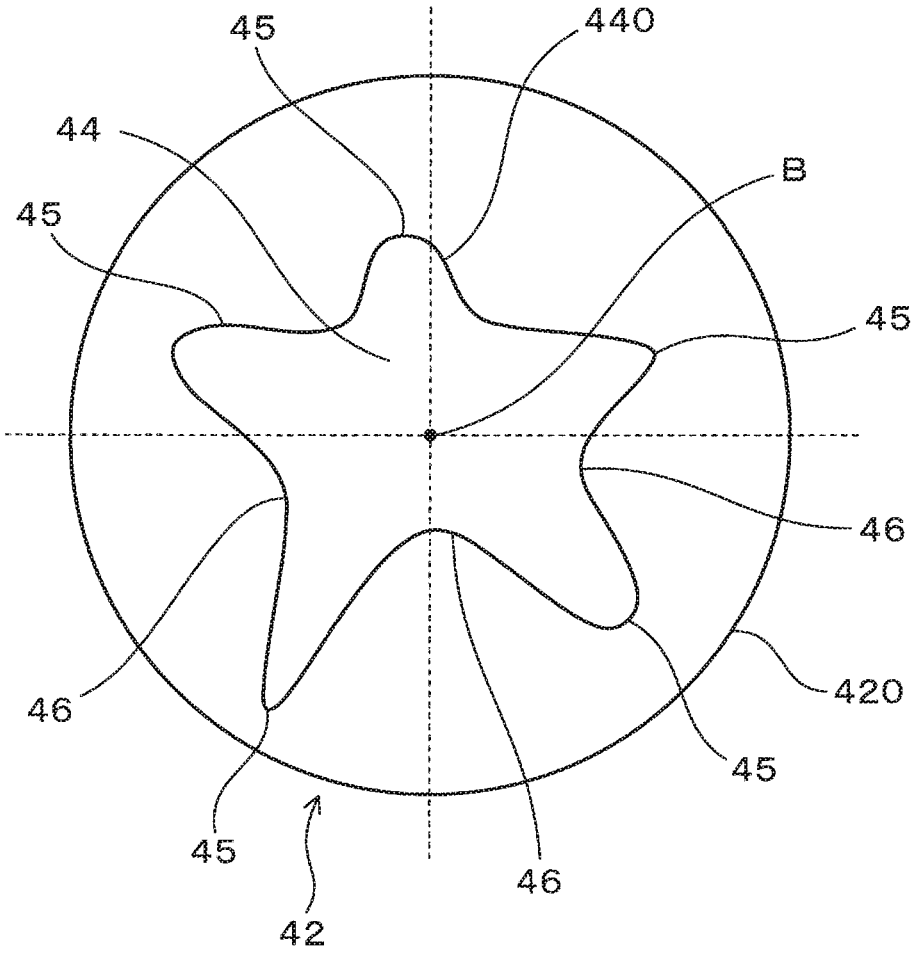
FIG. 14 is a plan view of still another example of the electrode head in which the concave contour has a non-rotationally symmetrical shape.

The present disclosure has been described according to the embodiments. However, the present disclosure should not be construed as being limited to the embodiments and structures. The scope of the present disclosure includes various modified examples and modifications within the range of equivalents. In addition, various combinations and forms, as well as other combinations and forms further including only one element, more elements, or less elements, are included within the scope and the spirit of the present disclosure. For example, in the embodiment described above, although the concave contour 440 has a rotationally symmetrical shape, the present invention is not necessarily limited thereto. For example, as shown in respective FIGS. 12, 13, and 14, the concave contour 440 may have a non-rotationally symmetrical shape about the center axis B. In these cases, the radii Rk, rk may vary greatly depending on k. A plurality of circumscribed circles C1 and a plurality of inscribed circles C2 also exist. In FIG. 12, these circumscribed circles C1 are denoted by C11, C12, and C13, and the inscribed circles C2 are denoted by C21, C22, and C23, by dash lines. These radii Rk and rk are denoted as R1, R2, R3, r1, r2, and r3, respectively.

The invention claimed is:

1. A spark plug for an internal combustion engine comprising:

a cylindrical housing;

a cylindrical insulator held inside the housing;

a center electrode held inside the insulator so that a tip end portion protrudes;

a ground electrode forming a spark discharge gap between the center electrode and the ground electrode; and a conductive glass filled in the insulator so as to be located at a base end side of the center electrode, wherein the center electrode has a locking portion locked from the base end side to a step portion formed on an inner peripheral surface of the insulator, and an electrode head closer to the base end side than the locking portion is;

the electrode head has a base end surface on which a concave portion is partially formed; and the concave contour, which is an outer peripheral contour of the concave portion when viewed in a plug axis direction, forms a closed curve which is spaced apart from a head contour, which is an outer peripheral contour of the base end surface of the electrode head, and surrounds the center axis of the center electrode, and the concave contour has outward portions each protruding toward the head contour and four inward portions each protruding toward the center axis of the center electrode, and wherein the distance between the concave contour and the head contour is 0.1 mm or more; and the four inward portions each has an inwardly curved shape protruding toward the center axis.

2. The spark plug for an internal combustion engine according to claim 1, wherein at least one of the outward portions has a curved shape.

3. The spark plug for an internal combustion engine according to claim 1, wherein the curved line of at least one of the outward portions is configured by a combination of curved lines having a radius of curvature of 0.1 mm or more.

4. A spark plug for an internal combustion engine comprising:

a cylindrical housing;

a cylindrical insulator held inside the housing;

a center electrode held inside the insulator so that a tip end portion protrudes;

a ground electrode forming a spark discharge gap between the center electrode and the ground electrode; and a conductive glass filled in the insulator so as to be located at a base end side of the center electrode, wherein the center electrode has a locking portion locked from the base end side to a step portion formed on an inner peripheral surface of the insulator, and an electrode head closer to the base end side than the locking portion is;

the electrode head has a base end surface on which a concave portion is partially formed; and the concave contour, which is an outer peripheral contour of the concave portion when viewed in a plug axis direction, forms a closed curve which is spaced apart from a head contour, which is an outer peripheral contour of the base end surface of the electrode head, and surrounds the center axis of the center electrode, and the concave contour has an outward portion protruding toward the head contour and an inward portion protruding toward the center axis of the center electrode, and wherein the distance between the concave contour and the head contour is 0.1 mm or more;

the concave contour includes N of the outward portions and N of the inward portions alternately arranged in a circumferential direction, a 1st outward portion to an Nth outward portion are sequentially arranged in the circumferential direction, and a 1st inward portion to an Nth inward portion are sequentially arranged in the circumferential direction, a kth outward portion and a kth inward portion are adjacent to each other, and when Rk is a radius of a circumscribed circle of the kth outward portion centering on the central axis, and rk is a radius of an inscribed circle of the kth inward portion centering on the central axis B, a following expression is satisfied, where N is a natural number of 2 or more, k is a natural number of 1 to N, A=1.0 when N=2, and A=4.1 when N≥3:

[Expression 1]

$$\sum_{k=1}^{N} \frac{Rk - rk}{Rk} \times N^{0.9} \geq A. \quad \text{(Expression 1)}$$

5. The spark plug for an internal combustion engine according to claim 4, wherein in at least one pair of the outward portion and the inward portion adjacent to each other further satisfies a following expression, when the radius of the circumscribed circle of the outward portion is Rj, and the radius of the inscribed circle of the inward portion is rj:

$$(Rj-rj)/Rj \leq 0.87 \quad \text{(Expression 2)}$$

6. A spark plug for an internal combustion engine comprising:

a cylindrical housing;

a cylindrical insulator held inside the housing;

a center electrode held inside the insulator so that a tip end portion protrudes;

a ground electrode forming a spark discharge gap between the center electrode and the ground electrode; and a conductive glass filled in the insulator so as to be located at a base end side of the center electrode, wherein the center electrode has a locking portion locked from the base end side to a step portion formed on an inner peripheral surface of the insulator, and an electrode head closer to the base end side than the locking portion is;

the electrode head has a base end surface on which a concave portion is partially formed;

the concave contour, which is an outer peripheral contour of the concave portion when viewed in a plug axis direction, forms a closed curve which is spaced apart from a head contour, which is an outer peripheral contour of the base end surface of the electrode head, and surrounds the center axis of the center electrode, and the concave contour has an outward portion protruding toward the head contour and an inward portion protruding toward the center axis of the center electrode; and the concave contour includes N of the outward portions and N of the inward portions alternately arranged in a circumferential direction, a 1st outward portion to an Nth outward portion are sequentially arranged in the circumferential direction, and a 1st inward portion to an Nth inward portion are sequentially arranged in the circumferential direction, a kth outward portion and a kth inward portion are adjacent to each other, and when Rk is a radius of a circumscribed circle of the kth outward portion centering on the central axis, and rk is a radius of an inscribed circle of the kth inward portion centering on the central axis B, a following expression (1) is satisfied, where N is a natural number of 2 or more, k is a natural number of 1 to N, A=1.0 when N=2, and A=4.1 when N≥3:

[Expression 1]

$$\sum_{k=1}^{N} \frac{Rk - rk}{Rk} \times N^{0.9} \geq A. \quad \text{(Expression 1)}$$

7. The spark plug for an internal combustion engine according to claim 6, wherein in at least one pair of the outward portion and the inward portion adjacent to each other further satisfies a following expression, when the radius of the circumscribed circle of the outward portion is Rj, and the radius of the inscribed circle of the inward portion is rj:

$$(Rj-rj)/Rj \leq 0.87 \quad \text{(Expression 2)}$$

8. The spark plug for an internal combustion engine according to claim 6, wherein a distance between the concave contour and the head contour is 0.1 mm or more.

* * * * *